United States Patent [19]

LeKuch et al.

[11] Patent Number: 4,944,403

[45] Date of Patent: Jul. 31, 1990

[54] SHOCK MOUNT CONTAINER

[75] Inventors: Herbert W. LeKuch, New York; Herbert S. Kulik, Dix Hills, both of N.Y.; Nicholas J. Lucia, Jr., West Caldwell, N.J.

[73] Assignee: Vibration Mountings & Controls, Inc., Bloomingdale, N.J.

[21] Appl. No.: 445,377

[22] Filed: Dec. 4, 1989

[51] Int. Cl.[5] ..... B65D 43/04

[52] U.S. Cl. ..... 206/594; 206/521; 220/256; 220/315; 220/358

[58] Field of Search ..... 206/521, 591, 594, 3; 220/66, 256, 315, 318, 233, 358, 378, 240; 229/4.5, 93

[56] References Cited

U.S. PATENT DOCUMENTS

| | | | |
|---|---|---|---|
| 1,243,974 | 10/1917 | Powers et al. | 220/233 |
| 2,395,252 | 2/1946 | Carpenter | 206/591 |
| 2,602,565 | 7/1952 | Regan | 220/378 |
| 2,721,652 | 10/1955 | Lyon | 206/3 |
| 2,835,404 | 5/1958 | Andrus | 220/378 |
| 3,443,735 | 5/1969 | Meijers | 220/319 |
| 3,669,304 | 6/1972 | Hansen | 220/315 |
| 3,997,078 | 12/1976 | Melton et al. | 220/315 |
| 4,279,339 | 7/1981 | Gotter | 206/3 |
| 4,337,869 | 7/1982 | Guinle | 220/256 |
| 4,605,140 | 8/1986 | Koors | 220/233 |

FOREIGN PATENT DOCUMENTS

| | | | |
|---|---|---|---|
| 0685952 | 5/1964 | Canada | 220/258 |
| 0704190 | 2/1954 | United Kingdom | 220/233 |

*Primary Examiner*—Jimmy G. Foster
*Attorney, Agent, or Firm*—Wolder, Gross & Bondell

[57] ABSTRACT

A shock-resistant container consists of a container body dimensioned to receive a shock-sensitive object. An elastomeric element having a peripheral lip and a central shock-absorbing pedestal is placed within the container upon the inserted object and extends substantially across the inside diameter of the container in a non-wall-contacting configuration. The cover is engageable with the elastomeric element and causes the peripheral lip to engage the side wall and the cover to contact the pedestal, resulting in the elastomeric element being retained in a contents-sealing and shock absorbing configuration between the cover and the enclosed object.

7 Claims, 2 Drawing Sheets

FIG. 3
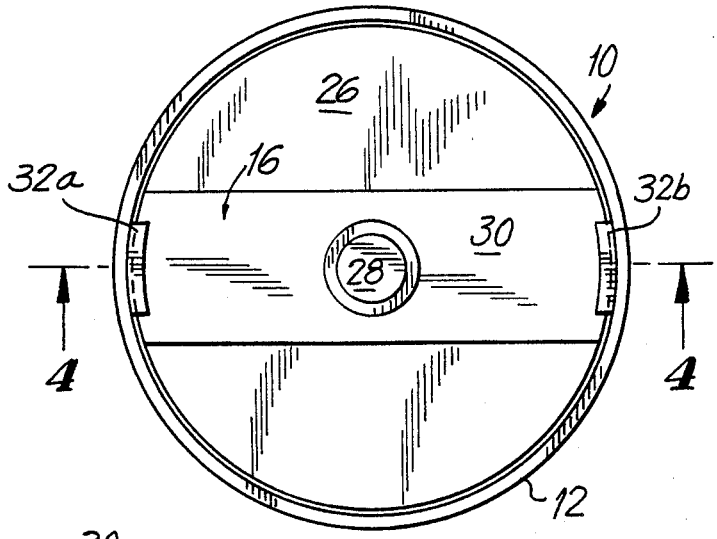
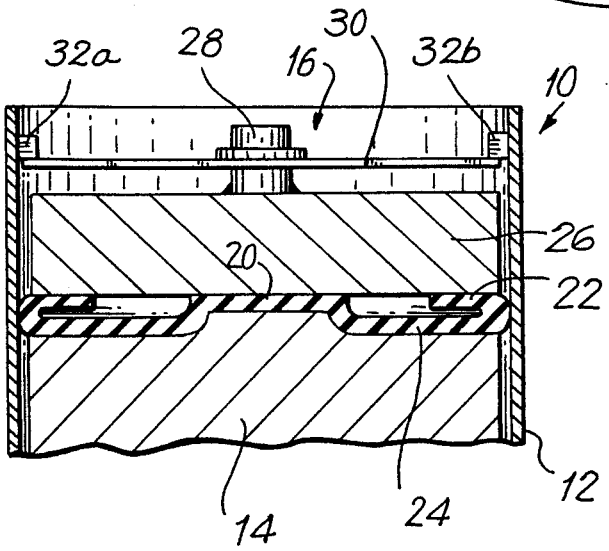
FIG. 4

SHOCK MOUNT CONTAINER

The present invention relates to a new and improved apparatus for the storage and transport of shock-sensitive items and, in particular, to a container assembly which incorporates a new and improved construction which provides both shock-absorption, as well as sealing for the container.

BACKGROUND OF THE INVENTION

Shock sensitive items, ranging from electronic equipment to explosives and ammunition, necessitate special care in their storage and transport. Towards such an end, the containers for such items must be specially adapted to isolate and protect the items. Traditionally, containers for shock-sensitive objects and equipment have utilized a shock-absorbing cushion which is placed between the object and the container, along with a separate and independent element, often the cover, which is utilized to provide a waterproof closure. The inclusion of two separate elements can subject the container to improper assembly, the loss of components, and otherwise can result in one of the shock mount or seal elements not being installed or functioning properly in the assembled configuration.

It is thus a purpose of the present invention to provide a container having a combined seal and shock mount assembly in which both functions are combined in a unitary structure.

Yet another purpose of the present invention is to provide such a combined seal and shock mount unit in a unit which is economical to manufacture and convenient to operate.

Yet a further purpose of the present invention is to provide a combined seal and shock mount assembly which may be produced with the necessary deflection requirements to be usable in a variety of environments.

BRIEF DESCRIPTION OF THE INVENTION

In accordance with the above and other objects and purposes, the present invention comprises a container in which shock-sensitive objects are to be placed and a cooperating top or cover having a portion which may be displaced downwardly into the container as part of the sealing process. A combined sealing and shock cushioning member is inserted within the container, normally on top of the inserted objects, and is contacted and compressed by the action of the cover. The seal/-shock mount element includes a peripheral portion which is displaced outwardly against the container sides as initial movement of the cover occurs. Additional travel of the cover engages the shock-absorbing portion of the element, whereby a shock mount is provided between the enclosed object and the cover and container.

Upon releasing and retracting the cover, the shock-absorbing portion is disengaged, followed by the return of the peripheral edge of the element to its previous configuration, withdrawn from the side wall. The cover and seal shock element can then be easily removed from the container, the enclosed objects being fully accessible.

BRIEF DESCRIPTION OF THE DRAWINGS

A fuller understanding of the present invention and the features associated therewith may be accomplished upon consideration of the following, detailed description of a preferred, but nonetheless illustrative embodiment of the present invention taken in association with the annexed drawings, wherein

FIG. 3 is a top plan view showing the cover in a second closed and locked position; and FIG. 4 is a side elevation view, in section, taken along line 4—4 of FIG. 3 showing the combined seal/shock absorption element in the compressed and operative position.

DETAILED DESCRIPTION OF A PREFERRED EMBODIMENT

Figure 1:
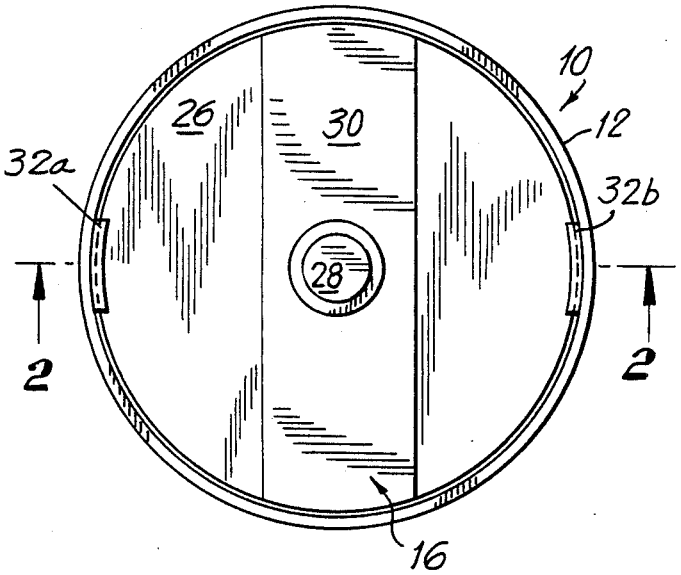
FIG. 1 is a top plan view of the container assembly embodying the present invention, showing the cover in place in a first open and unlocked position.
Figure 2:
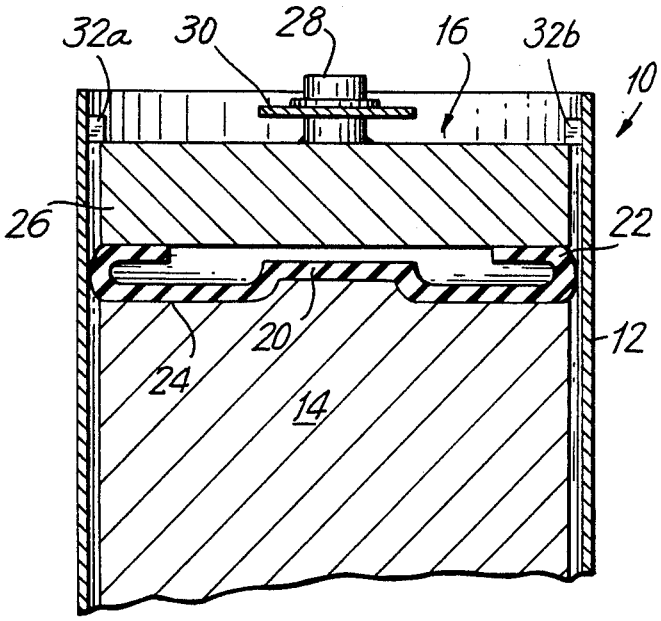
FIG. 2 is a side elevation view, in section, taken alone line 2—2 of FIG. 1, detailing the combined seal/shock absorption element in the first state.

Referring initially to FIGS. 1 and 2, container 10 having side wall 12 may be formed in any shape appropriate for storing the contents 14 therein. As depicted in the Figures, the container may be of a cylindrical shape, generally conforming to the diameter of cylindrically-shaped contents 14. Other configurations may include oval or polygonal as may be required by the contents. Cover 16 is adapted and dimensioned to fit generally within the container side wall. An elastomeric element 18, which both seals the container and provides shock absorption, is located within the container upon the top surface of the contents 14, and is adapted to be stressed by a downward force exerted against it by the bottom surface of cover 16.

In particular, the elastomeric element 18 may be of the same general shape in plan as the interior of the container 10. In other words, for a cylindrical container 10 as depicted in the Figures, elastomeric element 18 is generally disk-shaped. The element 18 is formed of an appropriate material, such as EDPM rubber, and includes a generally circular raised central pedestal portion 20 and an upwardly and inwardly curved peripheral lip 22 joined to the pedestal by intermediate body portion 24. The diameter of the elastomeric element in the unstressed state is chosen to be slightly less than the interior diameter of the container, such that it may be inserted and removed from the container without difficulty. In practice, a diameter approximately .015 to .020" smaller than the inner diameter of the container has been found appropriate. The peripheral lip 22 extends above the height of the pedestal portion 20 such that, as the cover 16 is installed, it first engages the peripheral lip 22.

As depicted in the Figures, the cover 16 may be provided with a central plate portion 26 of a diameter sufficient to overlie the peripheral lip 22 of elastomeric element 18. Extending upward from the plate 26 is pin 28, to which cross-piece/handle 30 is mounted. The crosspiece 30 is dimensioned such that it may be engaged with opposed locking elements 32*a*, b located on side wall 12 as the cover 16 is rotated in the position shown in FIGS. 1 and 2 to the position shown in FIGS. 3 and 4. The lock elements 32 may be of any one of a variety of known constructions, and may, for example, include an inclined internal surface (not shown) whereby the cover 16 is driven downwardly as the crosspiece 30 contacts and engages the lock elements. Alternatively, the cover may be designed to be depressed manually, the lock elements 32*a,b* providing a stop and support mechanism for the crosspiece when the cover is in the depressed position.

As shown in FIGS. 3 and 4, the cover is forced downwardly into the container such that peripheral lip 22 of the elastomeric element 18 is compressed by plate 26, flexing the lip downwardly and outwardly into contact with the inner surface of side wall 12. This contact, which occurs about the entire periphery of the elastomeric element, creates a continuous seal about the side wall, isolating the enclosed contents 14 from the external atmosphere.

Downward motion of the cover 16 is continued, increasing the seal, until the bottom surface of cover plate 26 contacts central pedestal portion 20 of the elastomeric element, as may be best seen in FIG. 4. That position, which corresponds to the fully engaged and locked orientation of the crosspiece 30 with respect to lock elements 32, creates a shock mount for the contents 14, the elastomeric properties of central pedestal 20 serving to dampen and arrest shock forces experienced by the container 10 which would otherwise be passed directly to the contents 14. In practice, it has been found that a peripheral lip extending approximately .2 to .25" above central pedestal 20 creates an effective seal as the cover contacts the central pedestal. It further has been found that the central pedestal may compress approximately .35 to 0.40" during shock, thus effectively mitigating the effects of the shock experienced by the load.

Because of its simplified design, the present shock mount/seal unit is greatly resistant to user error. In addition, as the elastomeric element is dimensioned to have a free fit within the container in its unstressed state, it and the cover can be installed and operated without special tools. Further, as the lock elements 32 may provide for a series of steps, or positions for crosspiece 30, each corresponding to greater compression of central pedestal 20, it is possible to provide a choice of pre-load forces against the pedestal, thus allowing the response of the unit to be adjusted as may be required by the contents to be protected.

We claim:

1. A shock-resistant container for objects placed therein comprising: a container body having a peripheral side wall, said container being dimensioned to receive a shock-sensitive object therein; a cover; and an elastomeric element dimensioned to be placed within said container upon the top of said inserted object and extending substantially across the inside diameter thereof in a non-wall-contacting configuration therewith, said elastomeric element being of generally planar configuration and having a flexible, upwardly-extending, peripheral lip and a central shock-absorbing pedestal; said cover being engageable with said elastomeric element whereby said peripheral lip engages said side wall and said cover is in contact with said pedestal, said elastomeric element being retained in a contents-sealing and shock-absorbing configuration between said cover and said object.

2. The apparatus of claim 1, wherein said cover is engaged with said side wall when in said elastomeric element-contacting position.

3. The apparatus of claim 2, wherein said side wall comprises means for directing said cover downward into contact with said elastomeric element as said cover is rotated.

4. The apparatus of claim 2, wherein the diameter of said elastomeric element is between .015 and .020" less than the inner diameter of said container body.

5. The apparatus of claim 2, wherein said peripheral lip extends upwardly above the top of said pedestal.

6. The apparatus of claim 3, wherein said directing means includes stop means to selectively retain said cover in a plurality of positions along its path of downward travel.

7. The apparatus of claim 2, wherein said cover is adapted to contact said peripheral wall prior to said pedestal.

* * * * *